US006921193B2

(12) United States Patent
Fukui

(10) Patent No.: US 6,921,193 B2
(45) Date of Patent: Jul. 26, 2005

(54) CHEMICAL CONCENTRATION CONTROL DEVICE FOR SEMICONDUCTOR PROCESSING APPARATUS

(75) Inventor: Akira Fukui, Oume (JP)

(73) Assignee: Kaijo Corporation, Hamura (JP)

( * ) Notice: Subject to any disclaimer, the term of this patent is extended or adjusted under 35 U.S.C. 154(b) by 78 days.

(21) Appl. No.: 10/292,228

(22) Filed: Nov. 12, 2002

(65) Prior Publication Data

US 2003/0095472 A1 May 22, 2003

(30) Foreign Application Priority Data

Nov. 19, 2001 (JP) ..... 2001-353759

(51) Int. Cl.[7] ..... B01F 15/04
(52) U.S. Cl. ..... 366/152.1; 366/160.2
(58) Field of Search ..... 366/132, 134, 366/136, 137, 152.1, 152.4, 160.1, 160.2; 137/5, 93, 563; 700/265–267

(56) References Cited

U.S. PATENT DOCUMENTS

| | | | | |
|---|---|---|---|---|
| 4,031,912 A | * | 6/1977 | Lu et al. | 137/5 |
| 4,621,927 A | * | 11/1986 | Hiroi | 366/132 |
| 5,522,660 A | * | 6/1996 | O'Dougherty et al. | 366/136 |
| 5,800,056 A | * | 9/1998 | Suzuki et al. | 366/152.4 |
| 6,572,255 B2 | * | 6/2003 | Husher | 366/132 |
| 6,659,634 B2 | * | 12/2003 | Hiraoka et al. | 366/151.1 |
| 2004/0100860 A1 | * | 5/2004 | Wilmer et al. | 366/136 |

FOREIGN PATENT DOCUMENTS

| | | | |
|---|---|---|---|
| DE | 4133074 A1 | * | 4/1992 |
| JP | 10-154681 A | | 9/1998 |
| JP | 11-224871 A | | 8/1999 |
| JP | 2000-058499 A | | 2/2000 |
| JP | 2000-150447 A | | 5/2000 |
| JP | 2001-9257 | * | 1/2001 |
| JP | 2004-24954 | * | 1/2004 |

* cited by examiner

*Primary Examiner*—Charles E. Cooley
(74) *Attorney, Agent, or Firm*—Frishauf, Holtz, Goodman & Chick, P.C.

(57) ABSTRACT

A chemical concentration control device for a semiconductor processing apparatus being capable of keeping processing chemicals at constant concentrations, and of maintaining the liquid level required for processing is provided. A semiconductor processing apparatus includes a concentration measuring unit, a drift observation unit, a replenishment quantity calculating unit, a concentration estimating unit, a fixed-quantity replenishment processing unit, and a replenishment control unit for controlling replenishment of chemicals based on the replenishment quantities calculated by the fixed-quantity replenishment processing unit, so that the replenishment quantity calculating unit calculates the replenishment quantities of the respective chemicals with respect to the predetermined reference replenishment quantity based on data measured by the concentration measuring unit and the drift observation unit, and estimated concentration data supplied from the concentration estimating unit.

4 Claims, 8 Drawing Sheets

CHEMICAL CONCENTRATION CONTROL DEVICE FOR SEMICONDUCTOR PROCESSING APPARATUS

BACKGROUND OF THE INVENTION

1. Field of the Invention

The present invention relates to a chemical concentration control device for a semiconductor processing apparatus for keeping the concentrations of processing chemicals constant and maintaining the liquid level of chemicals required for processing semiconductors at a certain level.

2. Description of the Related Art

In the semiconductor processing apparatus such as a wet station, chemical concentrations may vary and the chemical quantities may be reduced due to repeated unloading of wafers from a processing bath or due to evaporation of chemicals. Therefore, it is necessary to maintain the concentrations and quantities of chemicals at constant values by adding them periodically.

FIG. 1 is a block diagram showing an apparatus for controlling chemical concentrations for a semiconductor processing apparatus in the related art. In order to maintain chemical concentrations or liquid level at constant values, chemical concentrations are measured with a concentration meter 7 as shown in FIG. 1. A replenishment control unit 40 checks whether or not concentration data measured by the concentration meter 7 falls within a reference range, selects the set values for replenishment for the case where the concentration data falls within the reference range and for the case where it is outside the reference range respectively, issues signals to a replenishment pump (not shown) at a replenishing station 28, and replenishes chemicals as needed. The chemical concentration control device for a semiconductor processing apparatus shown in FIG. 1 constitutes a concentration feedback control system that compares concentration data measured by the concentration meter 7 with the reference range of concentrations and controls chemical concentrations so that they fall within the reference range.

In control of chemical replenishment, as shown in FIG. 2, predetermined quantities of chemicals are replenished based on a replenishment cycle timer built in the replenishment control unit 40 for measuring a certain cycle time and a chemical replenishment timer actuated synchronously with the replenishment cycle timer. FIG. 2 is a timing chart for replenishment control of three types of chemicals (Chemical A, Chemical B, and Chemical C).

As shown in FIG. 2, a replenishment timer for Chemical A, a replenishment timer for Chemical B, and a replenishment timer for Chemical C are actuated based on signals from the replenishment cycle timer in the replenishment control unit 40. The setting time of the replenishment timer for Chemical A is represented by T1, the setting time of the replenishment timer for Chemical B is represented by T2, and the setting time of the replenishment timer for Chemical C is represented by T3. These replenishment timers activate the replenishing pumps provided for the respective chemicals for the periods of time T1, T2 and T3 to replenish certain quantities of chemicals. Chemicals are replenished depending on their concentrations. For example, when the concentration of Chemical A is higher than the reference range and the concentration of Chemical B is lower than the reference range, Chemical A is replenished by a small quantity, and Chemical B is replenished by a large quantity. In this manner, the semiconductor processing apparatus in the related art is adapted to replenish predetermined certain quantities of chemicals to maintain the chemicals at constant concentrations.

However, in chemical replenishment control based on the comparison between concentration data obtained by the concentration meter and the reference range of concentration as a target value conducted by the replenishment control unit 40 in the related art, since concentration data (P) is settled at the timing t=m2 after chemicals are replenished at the timing t=0 under the influence of the time required for mixing chemicals or of the time required for measuring chemical concentrations by the concentration meter as shown in FIG. 3, an overhead time m2 (shown in FIG. 4) is generated in the concentration feedback control system.

Therefore, as shown in FIG. 4, when trying to control chemical concentrations so as to fall within the reference range, chemical concentrations may vary because there may be the cases where the chemical concentrations exceed the upper limit of the reference range or underrun the lower limit of the reference range of concentration under the influence of the overhead time m2. Likewise, there may be the case where the concentration cannot be controlled with a high degree of accuracy due to the overhead time m2 even when PID (proportional-plus-integral-plus-derivative) control is employed. Due to variations in chemical concentrations, processing such as washing and etching are not stable, which may result in lowering of yielding percentage of the semiconductor. Therefore, it is required to maintain the chemicals in the semiconductor processing apparatus at constant concentrations.

BRIEF SUMMARY OF THE INVENTION

In view of such problems in the replenishment control unit for controlling chemical concentrations for a semiconductor processing apparatus in the related art, an object of the invention is to provide a chemical concentration control device for a semiconductor processing apparatus being capable of keeping processing chemicals at constant concentrations and being capable of maintaining the liquid level of chemicals at a certain level required for processing by setting a replenishment quantity of liquid as a reference replenishment quantity in advance, calculating the replenishment quantities for the respective chemicals with respect to the reference replenishment quantity, and replenishing chemicals based on the replenishment quantities calculated for the respective chemicals.

The chemical concentration control device for a semiconductor processing apparatus according to the invention includes a concentration measuring unit for measuring chemical concentrations, a drift observation unit for observing the drift amount of concentrations after the overhead time generated in the concentration feedback control system has elapsed, a replenishment quantity calculating unit for calculating the quantities of chemicals to be replenished, a fixed-quantity replenishment processing unit for processing the replenishment quantity of each chemical so that the summation of the replenishment quantities of chemicals obtained by the replenishment quantity calculating unit becomes equal to the predetermined reference replenishment quantity, a concentration estimating unit for estimating concentrations to be achieved after chemicals have replenished by the replenishment quantities processed by the fixed-quantity replenishment processing unit, and a replenishment control unit for replenishing chemicals by the replenishment quantities processed by the fixed-quantity replenishment processing unit.

Preferably, the replenishment quantity calculating unit of the chemical concentration control device for a semiconductor processing apparatus of the invention calculates the replenishment quantities of chemicals based on concentration data measured by the concentration measuring unit, the drift amount of concentration observed by the drift observation unit, and estimated concentration data estimated by the concentration estimating unit.

Preferably, the fixed-quantity replenishment processing unit of the chemical concentration control device for a semiconductor processing apparatus of the invention processes the respective replenishment quantities of chemicals based on the priority for chemical replenishment.

Preferably, the replenishment control unit of the chemical concentration control device for a semiconductor processing apparatus of the invention replenishes chemical when the liquid level of chemical is lowered to a position below the predetermined level.

DESCRIPTION OF THE PREFERRED EMBODIMENTS

Figure 1:
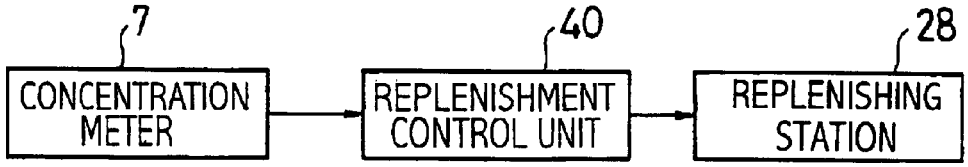
FIG. 1 (PRIOR ART)
FIG. 1 is a block diagram of a device for controlling chemical concentrations for a semiconductor processing apparatus in the related art.
Figure 2:
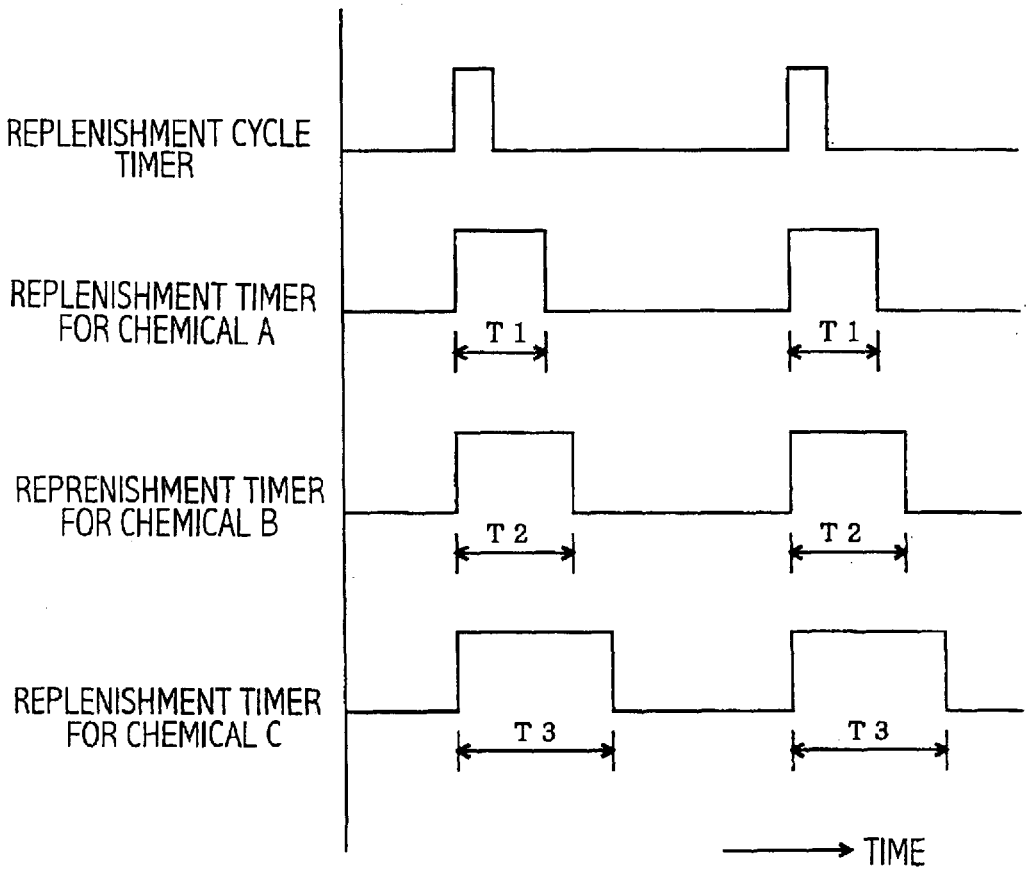
FIG.2 (PRIOR ART)
FIG. 2 is a timing chart illustrating timings of chemical replenishment based on a replenishment cycle timer and a replenishment timer activated synchronously therewith.
Figure 3:
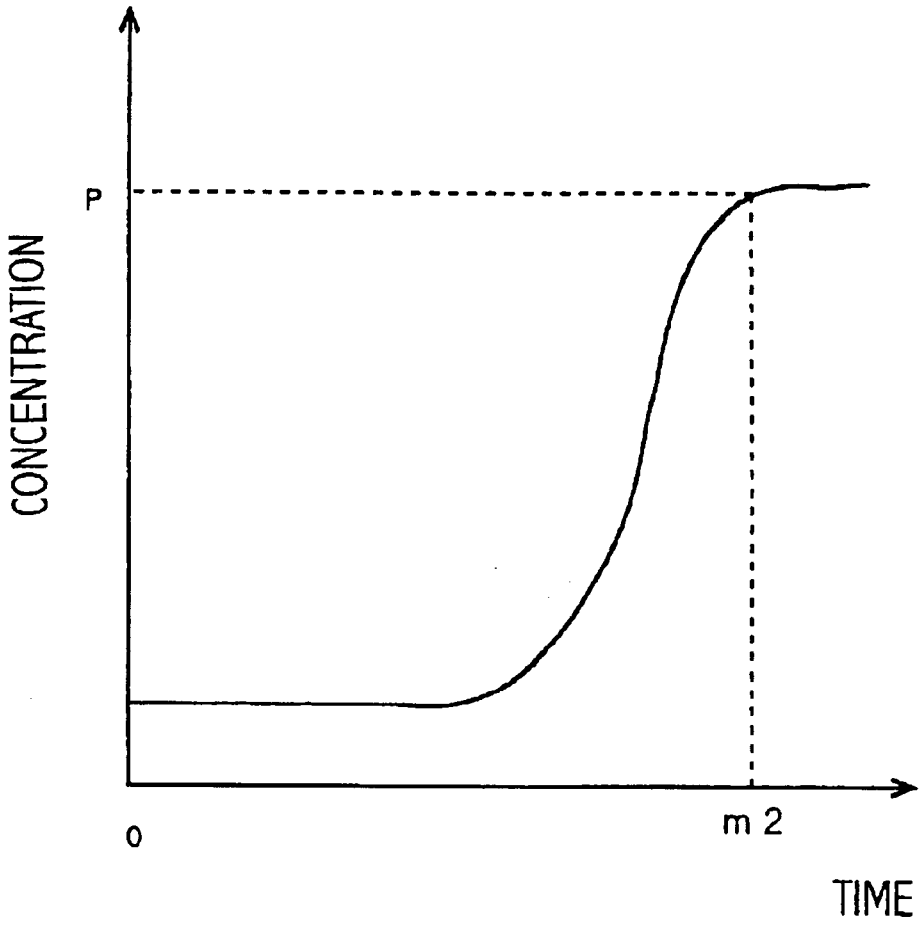
FIG.3 (PRIOR ART)
FIG. 3 is a drawing showing variations in concentration data in concentration control.
Figure 4:
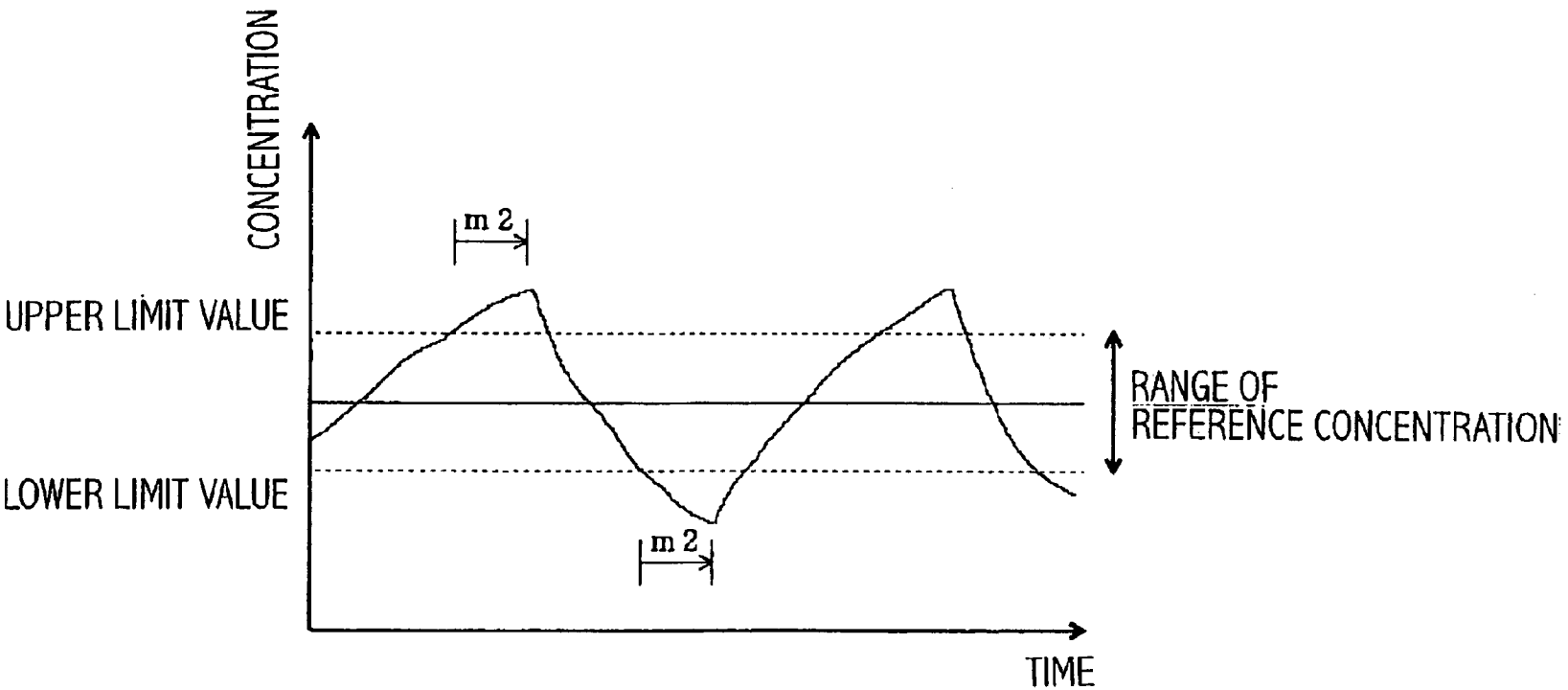
FIG.4 (PRIOR ART)
FIG. 4 is a drawing showing variations in concentration data measured by a concentration meter.
Figure 5:
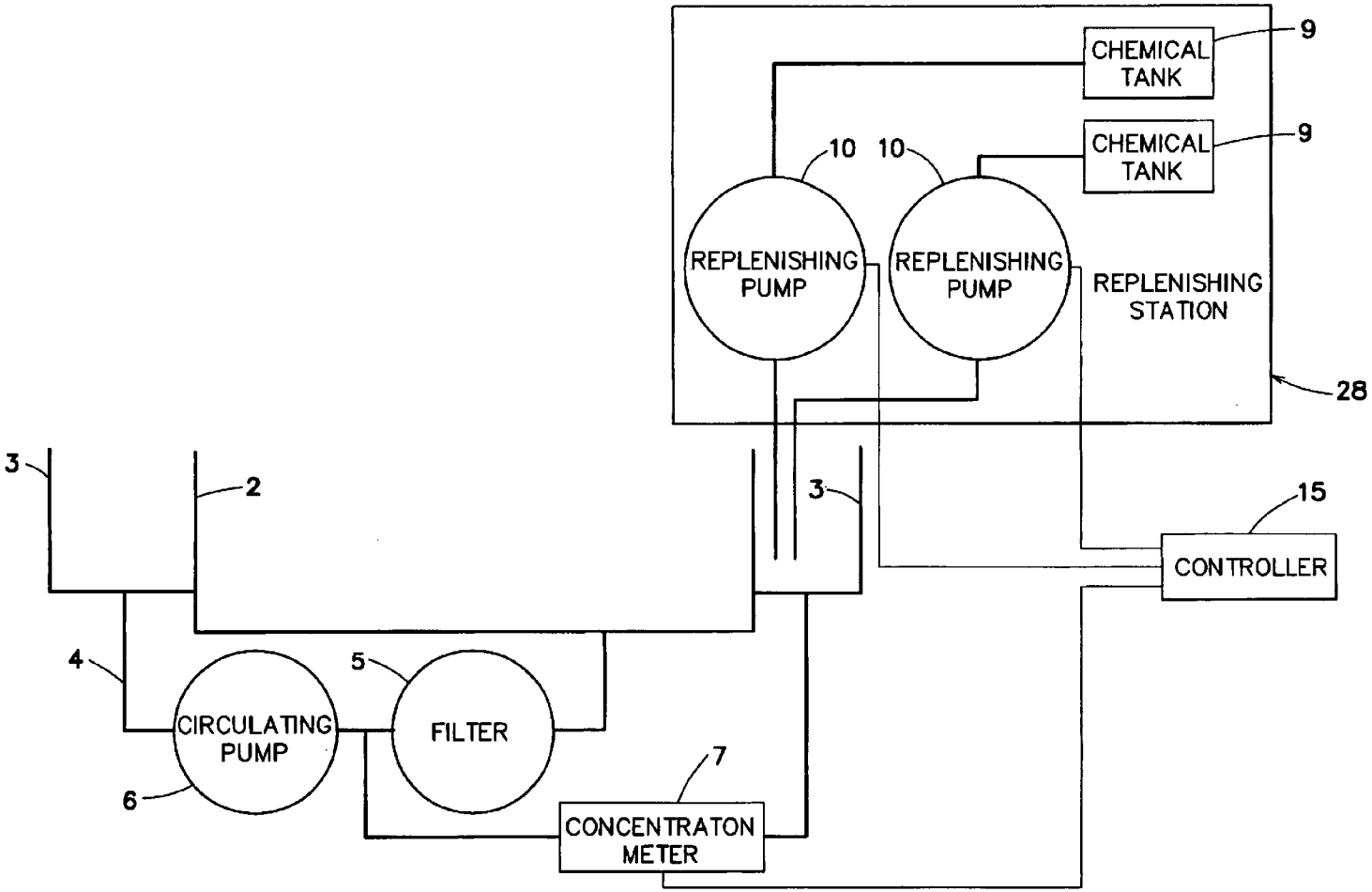
FIG. 5 is a block diagram showing the construction of a semiconductor processing apparatus provided with a chemical concentration control device.
Figure 6:
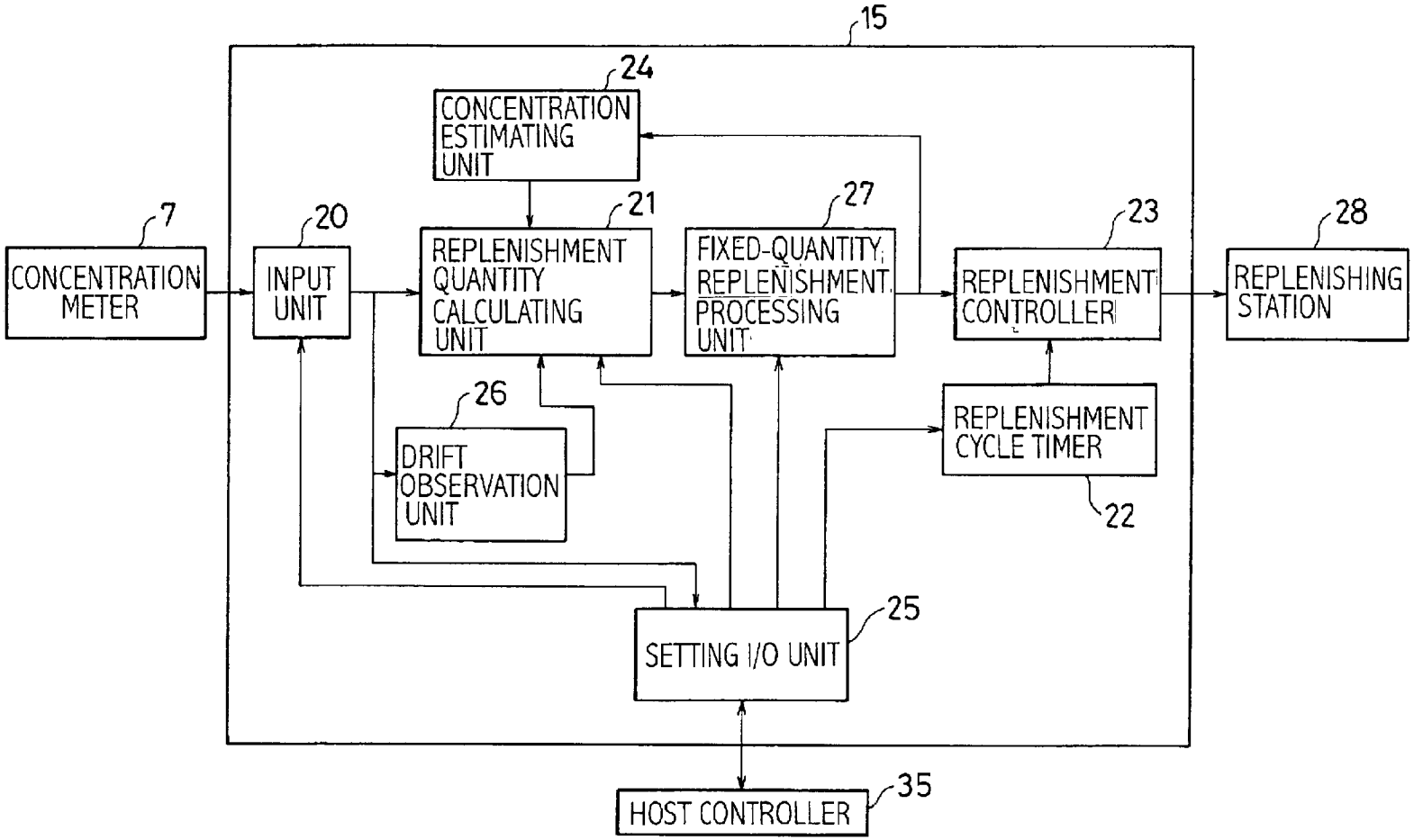
FIG. 6 is a block diagram showing the construction of a controller in the chemical concentration control device for a semiconductor processing apparatus according to the invention.
Figure 7:
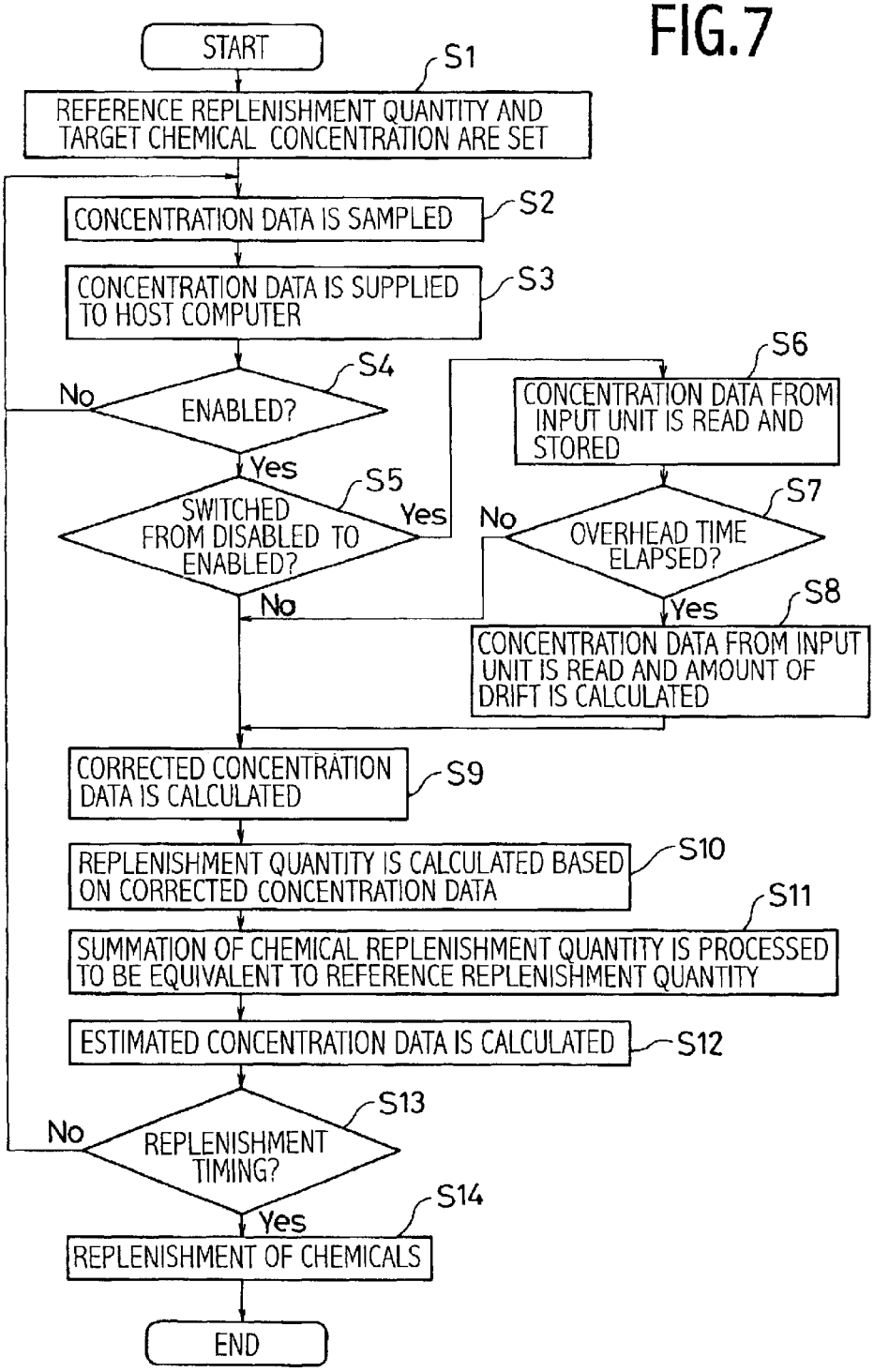
FIG. 7 is a flowchart of concentration control conducted by the chemical concentration control device for a semiconductor processing apparatus.
Figure 8:
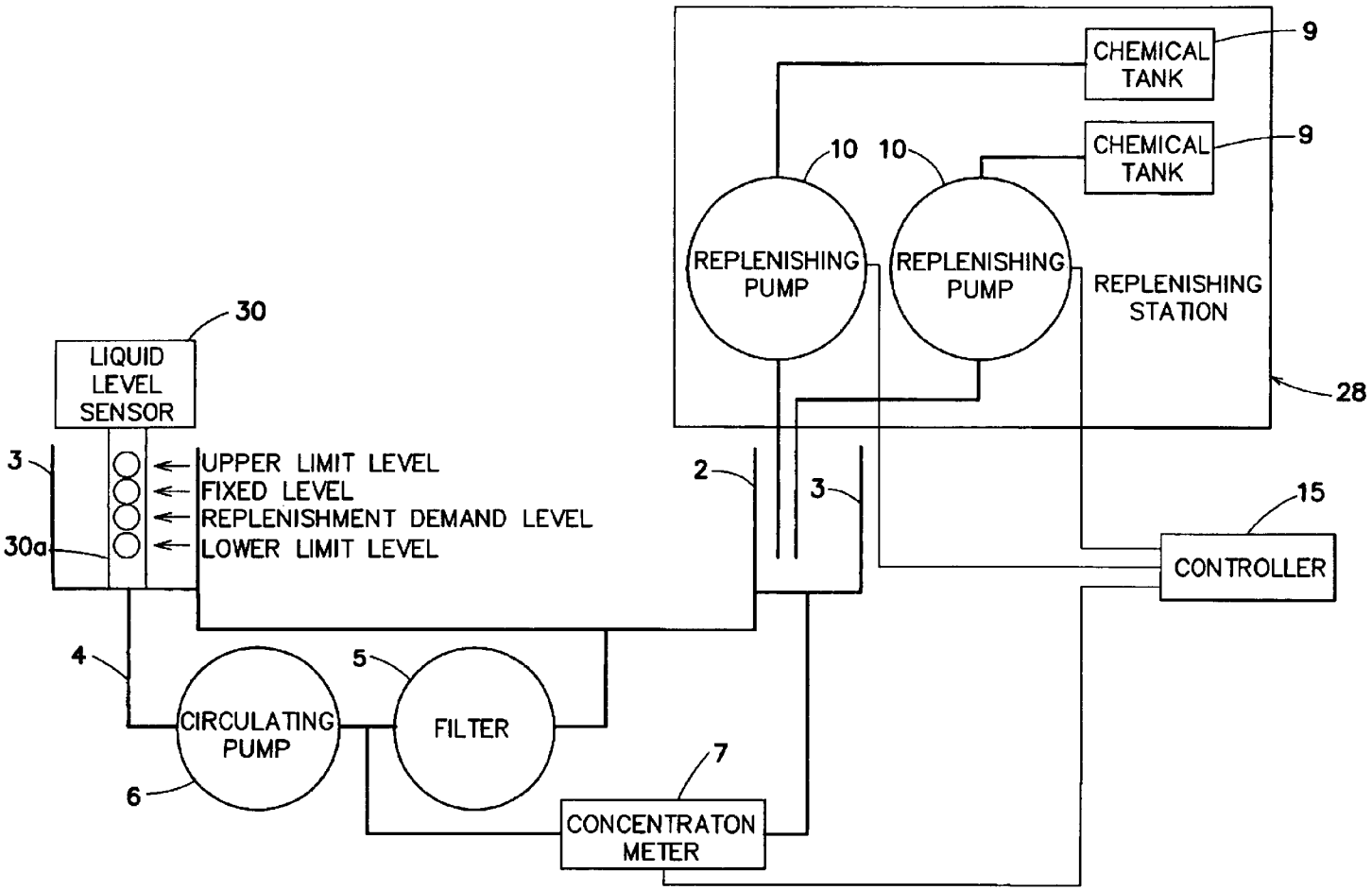
FIG. 8 is a block diagram showing the construction of the chemical concentration control device for a semiconductor processing apparatus employing a level gauge.

Referring now to the drawings, a chemical concentration control device for a semiconductor processing apparatus according to the invention will be described. FIG. 5 is a block diagram showing the construction of the semiconductor processing apparatus provided with a chemical concentration control device; FIG. 6 is a block diagram showing the construction of a controller in the chemical concentration control device for a semiconductor processing apparatus of the invention; FIG. 7 is a flowchart of concentration control conducted by the chemical concentration control device for a semiconductor processing apparatus; and FIG. 8 is a block diagram showing the construction of the chemical concentration control device for a semiconductor processing apparatus employing a level gauge.

As shown in FIG. 5, the semiconductor processing apparatus includes a processing bath 2 for carrying out processing such as washing by soaking a wafer such as a substrate into chemicals, an overflow tank 3 for storing the chemical overflowed from the processing bath 2, a chemical circulating channel 4 for circulating the chemicals from the overflow tank 3 and feed them to the processing bath 2, a replenishing station 28 including a chemical tank 9 for storing the chemicals for replenishment and a replenishing pump 10 for replenishing the chemical into the overflow tank 3, and a controller 15 for managing and controlling concentrations.

The chemical circulating channel 4 for circulating the chemicals includes a filter 5 for filtering the chemical, a circulating pump 6 for circulating the chemical, and a concentration meter 7 as a concentration measuring unit for measuring concentration of the chemical disposed en route. The concentration meter 7 as a concentration measuring unit is adapted to issue concentration data for the respective chemicals after a plurality of chemicals have mixed.

The chemical concentration control device for a semiconductor processing apparatus according to the invention includes the concentration meter 7 as a concentration measuring unit for measuring chemical concentrations, and the controller 15 for managing and controlling chemical concentrations. The chemical concentration control device for a semiconductor processing apparatus controls chemical concentrations by setting a total chemical replenishment quantity as a reference replenishment quantity in advance, and varying the mixing ratio of the respective chemicals with respect to the reference replenishment quantity. The reference replenishment quantity is set to the quantity required for maintaining the chemical at a certain liquid level.

The concentration meter 7 as concentration measuring means for measuring chemical concentrations is, as shown in FIG. 5, connected to the piping channel diverged from the secondary side of the circulation pump 6. The concentration meter 7 is adapted to output measured concentration data on the respective chemicals to the controller 15. The controller 15 of the chemical concentration control device is adapted to calculate the required replenishment quantities of chemicals based on concentration data from the concentration meter 7 and output the calculated replenishment quantities of chemicals to the replenishment pump 10 of the replenishing station 28. The replenishment pump 10 of the replenishing station 28 is adapted to replenish chemicals by the replenishment quantities supplied from the controller 15 into the processing bath 2 at predetermined timings. The controller 15 is connected to a host computer that corresponds to a host controller 35 (shown in FIG. 6) for controlling the wafer processing process, and performs controlled chemical replenishment according to the instructions from the host computer. The semiconductor processing apparatus provided with the chemical concentration control device shown in FIG. 5 constitutes a concentration feedback control system for controlling the chemicals to be the predetermined concentrations by calculating the required replenishment quantities of chemicals based on concentration data measured by the concentration meter 7 as concentration measuring means, and replenishing chemicals by the calculated replenishment quantities by the replenishing pump 10.

Referring now to a block diagram shown in FIG. 6, the controller 15 of the chemical concentration control device will be described.

As shown in FIG. 6, the controller 15 of the chemical concentration control device includes an input section 20 for sampling concentration data from the concentration meter 7 as concentration measuring means for measuring chemical concentrations, a replenishment quantity calculation unit 21 as replenishment quantity calculating means for calculating the replenishment quantities of chemicals based on concentration data from the concentration meter 7 as concentration measuring means sampled at the input unit 20, the drift amount of concentration observed by a drift observation unit 26 as drift observation means, and estimated concentration data estimated by the concentration estimating unit 24 as concentration estimating means, the drift observation unit 26 as drift observation means for measuring the drift amount (variation) of concentration data from the concentration meter 7 obtained after the overhead time of the concentration feedback control system has elapsed at the timing when the controller 15 is enabled from the disabled state, or at the timing when there is no influence of the chemical replenishment operation, a fixed-quantity replenishment processing unit 27 as fixed-quantity replenishment processing means for processing summation of replenishment quantities of the chemicals obtained at the replenishment quantity calculating unit 21 so as to become equal to a reference replenishment quantity, a replenishment cycle timer 22 for clocking the intervals of chemical replenishments at constant cycles, a replenishment controller 23 as replenishment control means for controlling the replenishing station 28 based on the replenishment quantities calculated by the fixed-quantity replenishment processing unit 27 at each periodical signal from the replenishment cycle timer 22, a concentration estimating unit 24 as concentration estimating means for estimating concentrations to be achieved after chemicals have replenished by the quantities calculated by the fixed-quantity replenishment processing unit 27, and supplying concentration data to be monitored to the host controller 35, setting parameters from a input device such as a keyboard or a touch panel, and a setting I/O unit 25 for outputting concentration data for monitoring to the host controller 35.

The input unit 20 for sampling concentration data from the concentration meter 7 samples concentration data from the concentration meter 7 at constant cycles to obtain moving average or arithmetic average for noise filtering, and provides obtained moving average or arithmetic average as concentration data.

The drift observation unit 26 as drift observation means measures variations in concentrations when the controller 15 is enabled form the disabled state based on the control signals supplied from the host controller 35. In other words, the chemicals are used in the heated state in some cases, and thus reduction of chemical concentrations occurs at a constant rate due to evaporation. Since the rate of reduction of chemical differs depending on the chemicals, when a volatile chemical is mixed with a non-volatile chemical, concentration of the former reduces and concentration of the latter increases. Such variations are observed by the drift observing unit 26 at the timing when there is no influence of the chemical replenishment operation, or at the timing when the controller 15 is enabled from the disabled state. Data observed by the drift observation unit 26 is converted into the drift amount during a control cycle and is used as offset data of concentration data in the replenishment quantity calculating unit 21. Accordingly, the influence of variations in concentrations due to variations in temperatures of the chemicals may be minimized.

The drift observation unit 26 is adapted to read and store concentration data (PVDn(0)) from the input unit 20 when the controller 15 is enabled from the disabled state, and read concentration data (PVDn(m)) from the input unit 20 after the preset overhead time m2 of the concentration feedback control system has elapsed, where n represents the kind of chemical. In this manner, the drift observation unit 26 is able to observe the drift amount accurately since it is not disturbed by the influence of the replenishing operation at the beginning of and during observation.

The drift amount of concentration after the overhead time has elapsed (PVDn) is calculated by the following expression;

$$PVDn=(PVDn(m)-PVDn(0)\times(Tcnt/m2) \quad (1)$$

where, Tcnt represents control cycle.

The drift amounts (PVDn) calculated for the respective chemicals are supplied from the drift observation unit 26 to the replenishment quantity calculating unit 21. The replenishment quantity calculating unit 21 as replenishment quantity calculating means calculates the replenishment quantities for the respective chemicals based on data such as the reference replenishment quantity, the target concentrations for the respective chemicals, concentration data of the respective chemicals, concentrations of chemical stock solutions, proportion of mixture of these chemicals, and specific gravities of chemicals.

Data including reference replenishment quantity, the target concentrations for the respective chemicals, concentrations of chemical stock solutions, proportion of mixture of these chemicals, and specific gravities of chemicals is supplied from the host controller 35 to the setting I/O unit 25, and then is supplied from the setting I/O unit 25 into the replenishment quantity calculating unit 21 as parameters. Data on concentrations of the respective chemicals is corrected data based on concentration data measured by the concentration meter 7 supplied from the input unit 7, the drift amount obtained from the drift observation unit 26, and estimated concentration data estimated by the concentration estimating unit 24.

In other words, corrected chemical concentrations (PVn) (hereinafter referred to as corrected concentration) is calculated by the expression below.

$$PVn=PVn'+FVn-SVn+PVDn+IntDPV \quad (2)$$

where, PVn represents a corrected concentration, PVn' represents a concentration data from the concentration meter 7 sampled by the input unit 20, FVn represents an estimated concentration data estimated by the concentration estimating unit 24, SVn represents a target concentration, PVDn represents the drift amount observed by the drift observation unit 26, IntDPV is an integrated value of (PVn'−SVn), that is, an integrated value of deviation of concentration data from the concentration meter 7 with respect to the target concentration.

The replenishment quantity calculation unit 21 calculates the replenishment quantities of the respective chemicals based on the corrected concentration (PVn), the reference replenishment quantity, the target concentrations, specific gravities of the respective chemicals, and the total quantity of chemicals in the processing bath 2. Data on the replenishment quantity of chemicals calculated by the replenishment quantity calculating unit 21 is supplied to the fixed-quantity replenishment processing unit 27 as fixed-quantity replenishment processing means, and the fixed-quantity replenishment processing unit 27 calculates the proportions of the respective chemicals with respect to the reference replenishment quantity predetermined by the setting I/O unit 25 so as to maintain concentrations of processing chemicals, and processes the summation of the replenishing quantities of the respective chemicals so as to be equal to the reference replenishment quantity.

For example, when the proportions of chemicals A, B, and C with respect to the reference replenishment quantity are 50%, 40%, and 30% in sequence as a result of calculation by the replenishment quantity calculating unit 21, the fixed-quantity replenishment processing unit 27 processes the replenishing quantities for the respective chemicals based on the priority for chemical replenishment preset by the setting I/O unit 25. For example, assuming that the priority for chemical replenishment is in order of A, B, and C, the fixed-quantity replenishment processing unit 27 processes the summation of the replenishment quantities of the respective chemicals so as to become equivalent to the reference replenishment quantity while determining the proportion of the chemicals to be 50% for the chemical A, 40% for the chemical B, and remaining 10% for chemical C.

Data on the replenishment quantities of the respective chemicals calculated by the fixed-quantity replenishment processing unit 27 is fed to the replenishment controller 15 and the concentration estimating unit 24. The replenishment controller 15 controls the replenishing station 28 to replenish predetermined quantities of chemicals by actuating the timer based on signals from the replenishment cycle timer 22. The replenishing station 28 may not necessarily be controlled by the timer, and the replenishing quantity may be controlled by the use of an integrated flowmeter or by counting the shot number of the replenishing pump 10.

The concentration estimating unit 24 as concentration estimating means is used for estimating concentrations to be achieved after chemicals have replenished by the replenishment quantities based on data on the replenishment quantities of the respective chemicals calculated by the fixed-quantity replenishment processing unit 27, and for correcting the overhead time of the concentration meter 7. The estimated concentration data calculated by the concentration estimating unit 24 is used as correction data for calculating the replenishment quantity after the overhead time has elapsed. In other words, when the estimated concentration data (FVn) is larger than the target concentration (SVn), the value of the corrected concentration (PVn) is increased to lower concentration of chemical in the processing bath 2, and when the estimated concentration data is smaller than the target concentration (SVn), the value of corrected concentration (PVn) is decreased to increase the concentration of chemical in the processing bath 2 by the expression (2). Accordingly, over-control of chemical concentrations due to the overhead time of the concentration feedback control system may be prevented.

Referring now to a flowchart shown in FIG. 7, the operation of concentration control of the chemical concentration control device for a semiconductor processing apparatus will be described.

As shown in FIG. 7, in a first place, data such as the reference replenishment quantity, the target concentrations for the respective chemicals, concentrations of stock solution of the chemicals, proportion of mixture of chemicals, and specific gravities of chemicals from the host controller 35 is set in the setting I/O unit 25 (Step S1).

Subsequently, the input unit 20 samples concentration data from the concentration meter 7 (Step S2). The concentration data sampled from the concentration meter 7 is supplied from the setting I/O output unit 25 to the host controller 35 (Step S3).

The controller 15 checks whether enabling signals are issued form the host controller 35 (Step S4). When the enabling signal is not issued, the operation from Step S2 is repeated. When the enabling signal is issued, whether or not it is enabled from the disabled state is checked (Step S5). If it is not enabled from the disabled state, the procedure goes to Step S9. If it is enabled from the disabled state, the drift observation unit 26 reads and stores concentration data (PVDn(0)) supplied from the input unit 20 (Step S6). Whether or not the preset overhead time m2 of the concentration feedback control system has elapsed is checked (Step S7). If the overhead time m2 has not elapsed, the procedure goes to step S9. If the overhead time m2 has elapsed, concentration data (PVDn(m)) from the input unit 20 is read, and the drift amount (PVDn) is calculated by the expression (1) and supplied to the replenishment quantity calculating unit 21 (Step S8).

Subsequently, the replenishment quantity calculating unit 21 calculates corrected concentration data from the expression (2) based on estimated concentration data calculated by the concentration estimating unit 24 in Step S12, and the drift amount calculated by the drift observation unit 26 (Step S9). The replenishment quantity calculating unit 21 calculates the replenishment quantity of, the respective chemicals based on the calculated corrected concentration data (Step S10). The fixed-quantity replenishment processing unit 27 processes so that summation of the replenishing quantities of the respective chemicals obtained by the replenishment quantity calculating unit 21 becomes equal to the reference replenishment quantity (Step S11).

The concentration estimating unit 24 calculates the estimated concentration data to be achieved after chemicals have replenished based on the replenishment quantity data for the respective chemicals calculated by the fixed-quantity replenishment processing unit 27, and supplies the calculated estimated concentration data to the replenishment quantity calculating unit 21 (Step S12). The replenishment controller 23 checks the replenishment cycle timer 22 whether it is the timing of replenishment (Step S13), and if not, the procedure goes to Step S2, and repeats the operation from Step S2. If it is the timing of replenishment, the replenishment controller 23 controls the replenishing station 28 based on the replenishment quantity of the chemicals calculated by the fixed-quantity replenishment processing unit 27, and replenishes predetermined quantities of chemicals in the processing bath 2 (Step S14).

In this manner, the reference replenishment quantity is distributed to the respective chemicals depending on the concentrations of the respective chemicals. Concentration and the quantity of the chemicals in the processing bath 2 are kept constant by replenishing the chemicals by the reference replenishment quantity in total. Accordingly, the liquid level required for processing may be maintained. It is also possible to replenish the chemicals when the liquid level of the chemicals in the processing bath 2 is out of the predetermined range of liquid level by the use of a liquid level sensor 30 instead of replenishment control by the replenishment cycle timer 22.

FIG. 8 is a block diagram showing the construction of the semiconductor processing apparatus for detecting the liquid quantity required for processing using the liquid level gauge. As shown in FIG. 8, the liquid level sensor 30 is mounted above the overflow tank 3, and a detection tube 30*a* of the liquid lever sensor 30 is positioned in the processing bath 2. The liquid level sensor 30 is adapted to detect the waterhead pressure generated in the detection nozzle in the detection tube 30*a* and detects the position of a plurality of liquid levels in the processing bath 2. The liquid level sensor 30 is, as shown in FIG. 8, the liquid levels to be detected are designated at four levels of an upper limit level, a fixed level, a replenishment demand level, a lower limit level so that the chemicals are replenished from the replenishing station 28 when the liquid level sensor 30 is turned "OFF" at the upper limit level and at the fixed-quantity level, and turned "OFF"

at the replenishment demand level. The reason why the liquid level is observed in the overflow tank 3 is because the liquid level in the overflow tank 3 varies due to the liquid quantity, although the liquid level in the processing bath 2 is constant since the chemicals are always circulated and overflowed from the processing bath 2.

Therefore, the liquid quantity required for processing may be controlled so as to fall within a predetermined range by detecting the liquid quantity required for processing by the liquid level sensor 30 and replenishing the chemicals based on the signals from the liquid level sensor 30.

According to the chemical concentration control device of the semiconductor processing apparatus of the invention, a three-chemical mixture or a two-chemical mixture may be used, and even water may be treated as a chemical.

As described thus far, the chemical concentration control device for a semiconductor processing apparatus of the invention, processing chemicals may be kept at constant concentrations since the replenishment quantity is calculated taking the overhead time of the concentration meter into account. Furthermore, the liquid quantity required for processing may be maintained by combining with the liquid sensor.

As described thus far, according to the chemical concentration control device for a semiconductor processing apparatus of the invention, the processing chemicals may be kept at constant concentrations and the liquid quantity required for processing may be maintained, and hence processing such as washing in the semiconductor processing device may be performed stably and uniform processing is achieved.

What is claimed is:

1. A chemical concentration control device for a concentration feedback control system of a semiconductor processing apparatus, said chemical concentration control device comprising:

a concentration measuring unit for measuring concentrations of chemicals;

a drift observation unit for observing a drift amount of the concentrations after an overhead time of the concentration feedback control system has elapsed;

a replenishment quantity calculating unit for calculating replenishment quantities of the chemicals;

a fixed-quantity replenishment processing unit for processing a replenishment quantity of each of the chemicals so that a summation of the replenishment quantities of respective chemicals calculated by the replenishment quantity calculating unit becomes equal to a predetermined reference replenishment quantity;

a concentration estimating unit for estimating concentrations to be achieved after the chemicals have been replenished by the replenishment quantities calculated by the fixed-quantity replenishment processing unit; and a replenishment control unit for controlling replenishment of the chemicals based on the replenishment quantities calculated by the fixed-quantity replenishment processing unit.

2. The chemical concentration control device according to claim 1, wherein the replenishment quantity calculating unit calculates the replenishment quantities of the chemicals based on (i) concentration data measured by the concentration measuring unit, (ii) the drift amount of concentrations observed by the drift observation unit, and (iii) estimated concentration data estimated by the concentration estimating unit.

3. The chemical concentration control device according to claim 1, wherein the fixed-quantity replenishment processing unit calculates the replenishment quantities of the chemicals based on a priority for chemical replenishment.

4. The chemical concentration control device according to claim 1, wherein the replenishment control unit replenishes the chemicals when a liquid level of the chemicals is lowered to a position below a predetermined level.

* * * * *